US007091710B2

(12) United States Patent
Yang et al.

(10) Patent No.: US 7,091,710 B2
(45) Date of Patent: Aug. 15, 2006

(54) LOW DROPOUT VOLTAGE REGULATOR PROVIDING ADAPTIVE COMPENSATION

(75) Inventors: Ta-yung Yang, Milpitas, CA (US); Jenn-yu G. Lin, Taipei (TW); Chien-Liang Chen, Jhonghe (TW)

(73) Assignee: System General Corp., Taipei Hsien (TW)

( * ) Notice: Subject to any disclaimer, the term of this patent is extended or adjusted under 35 U.S.C. 154(b) by 278 days.

(21) Appl. No.: 10/838,925

(22) Filed: May 3, 2004

(65) Prior Publication Data

US 2005/0242796 A1 Nov. 3, 2005

(51) Int. Cl.
*G05F 1/40* (2006.01)

(52) U.S. Cl. ..... 323/282

(58) Field of Classification Search ..... 323/265, 323/273, 280, 282, 349
See application file for complete search history.

(56) References Cited

U.S. PATENT DOCUMENTS 6,300,749 B1 * 10/2001 Castelli et al. ..... 323/273
6,975,099 B1 * 12/2005 Wu et al. ..... 323/280
2003/0218450 A1 * 11/2003 Bonte ..... 323/273

* cited by examiner

*Primary Examiner*—Karl Easthom
*Assistant Examiner*—Richard V. Muralidar
(74) *Attorney, Agent, or Firm*—J.C. Patents

(57) ABSTRACT

A method and apparatus to dynamically modify internal compensation of a low dropout (LDO) voltage regulator is provided. The LDO voltage regulator includes an output pass transistor, an error amplifier, a bias transistor and a compensation network. The compensation network is connected between a gate and a drain of the output pass transistor to compensate for the feedback loop. The compensation network and the bias transistor generate pole-zero pairs to perform a maximum 45 degrees phase shift before reaching the crossover frequency in the LDO voltage regulator. Therefore a minimum 45 degrees phase margin is provided for the feedback loop in various load conditions. Furthermore, the pole-zero pairs produced in the LDO voltage regulator are adaptively adjusted according to load conditions, so that the bandwidth is optimized and faster transient response is achieved.

6 Claims, 5 Drawing Sheets

LOW DROPOUT VOLTAGE REGULATOR PROVIDING ADAPTIVE COMPENSATION

BACKGROUND OF THE INVENTION

1. Field of Invention

The present invention relates to a voltage regulator circuit, and more particularly to a low dropout voltage regulator.

2. Description of the Related Art

Low dropout (LDO) voltage regulators are commonly used in power management systems of PC motherboards, laptop computers, mobile phones, and many other products. Power management systems use LDO voltage regulators as local power supplies, where a clean output and a fast transient response are required. LDO voltage regulators enable power management systems to efficiently supply additional voltage levels that are smaller than the main supply voltage. For example, 5V power systems of many PC motherboards use LDO voltage regulators to supply local chipsets with a clean 3.3V signal.

Although LDO voltage regulators do not convert power very efficiently, they are inexpensive, small, and generate very little frequency interference. Furthermore, an LDO voltage regulator can provide a local circuit with a clean voltage that is unaffected by current fluctuations from other areas of the power system. LDO voltage regulators are widely used to supply power to local circuits when the power consumption of the local circuit is negligible with respect to the overall load of the power system.

An ideal LDO voltage regulator should provide a quick and precise DC response to load changes and input transients. Since LDO voltage regulators are widely used in mass-production of computers and mobile phones, for example, a simple design and a low fabrication cost of LDO regulators are also desirable.

A typical LDO voltage regulator includes a feedback-control loop coupled to a pass element. The feedback-control loop modulates a gate voltage of the pass element to control its impedance. Depending on the gate voltage, the pass element supplies different levels of current to an output section of the power supply. The modulation of the gate voltage is done in a manner such that the LDO voltage regulator outputs a steady DC voltage, regardless of loading conditions and input transients.

Referring to FIG. 1, a basic configuration of a conventional LDO voltage regulator is illustrated. The conventional LDO voltage regulator includes an unregulated DC input terminal $V_{IN}$, an output pass transistor 10, a regulated DC output terminal $V_{OUT}$, and an output module including a load resistance 20, an output capacitor 21 and a parasitic equivalent series resistance (ESR) 22. The conventional LDO voltage regulator further includes a voltage divider having a voltage-dividing node FB, a resistor 31, and a resistor 32. The conventional LDO voltage regulator further includes a feedback-control circuit including an error amplifier 40 and a reference voltage port REF. The output impedance of the error amplifier 40 is denoted as a resistor 41, which is connected from an output of the error amplifier 40 to a reference ground level. A gate of the output pass transistor 10 has a parasitic capacitance denoted as a capacitor 42, which is connected from the gate of the output pass transistor 10 to the reference ground level. The unregulated DC input terminal $V_{IN}$ is connected to a source of the output pass transistor 10. A drain of the output pass transistor 10 is connected to the regulated DC output terminal $V_{OUT}$. The load resistance 20 and the output capacitor 21 are connected in parallel between the regulated DC output terminal $V_{OUT}$ and the reference ground level. The regulated DC output terminal $V_{OUT}$ is connected to the feedback-control circuit through the voltage divider. The resistor 31 and the resistor 32 are connected in series between the regulated DC output terminal $V_{OUT}$ and the reference ground level. The voltage-dividing node FB is located between the resistor 31 and the resistor 32. The voltage-dividing node FB is connected back to a positive input of the error amplifier 40. The reference voltage port REF is connected to a negative input of the error amplifier 40. An output of the error amplifier 40 is connected to the gate of the output pass transistor 10. Operation of this circuit is obvious to those skilled in the art.

One problem with the conventional LDO circuits described above is that they are prone to be unstable. The output module introduces a pole or a pole-zero pair to the feedback circuit. Unfortunately, the pole or the pole-zero pair is significantly sensitive to operating temperature, and possibly to other factors. If the load impedance varies by a specific amount, an unstable feedback loop may be incurred.

Another problem with the conventional LDO voltage regulators is that a transient response thereof is slow. The slow transient response is resulted from low bandwidth of the compensation feedback loop.

The conventional LDO voltage regulator is prone to unstable because the output impedance is various. Furthermore, performance thereof suffers from slow response. Therefore, an improved LDO voltage regulator with substantially faster transient response adapted to a variety of loads is needed.

SUMMARY OF THE INVENTION

The present invention is directed to provide an adaptive compensation scheme for a low dropout (LDO) voltage regulator, for serving a variety of load conditions.

The present invention is directed to provide a LDO voltage regulator serving improved transient response.

According to one aspect of the present invention, an LDO voltage regulator includes an output pass transistor having a source connected to an unregulated DC input terminal, a drain connected to a regulated DC output terminal, and a gate connected to an error amplifier. The error amplifier serves to control the output pass transistor. A bias transistor is coupled from an output of the error amplifier to the gate of the output pass transistor. A compensation network is connected between the gate and the drain of the output pass transistor for compensating the feedback loop. A first slice of the compensation network includes a first capacitor and a first transistor connected to each other in series. A second slice of the compensation network is connected in parallel to the first transistor, wherein the second slice includes a second capacitor and a second transistor connected in series. The compensation network further comprises a distribution network having a plurality of capacitors and transistors connected in parallel to the second transistor.

The compensation network and the bias transistor generate the pole-zero pairs to achieve a maximum 45 degrees phase shift before reaching the crossover frequency in the LDO voltage regulator. Therefore a minimum 45 degrees phase margin is reserved for the feedback loop in various load conditions. According to the present invention, the feedback loop of the LDO voltage regulator is inherently stable and not affected by load conditions. This is preferable because an unpredictable impedance change can be incurred with regarding temperature and applications.

According to another aspect of the present invention, the pole-zero pairs generated in the LDO voltage regulator are adaptively adjusted according to load conditions so that the bandwidth is optimized and a faster transition response is achieved.

DESCRIPTION OF THE EMBODIMENTS

Figure 1:
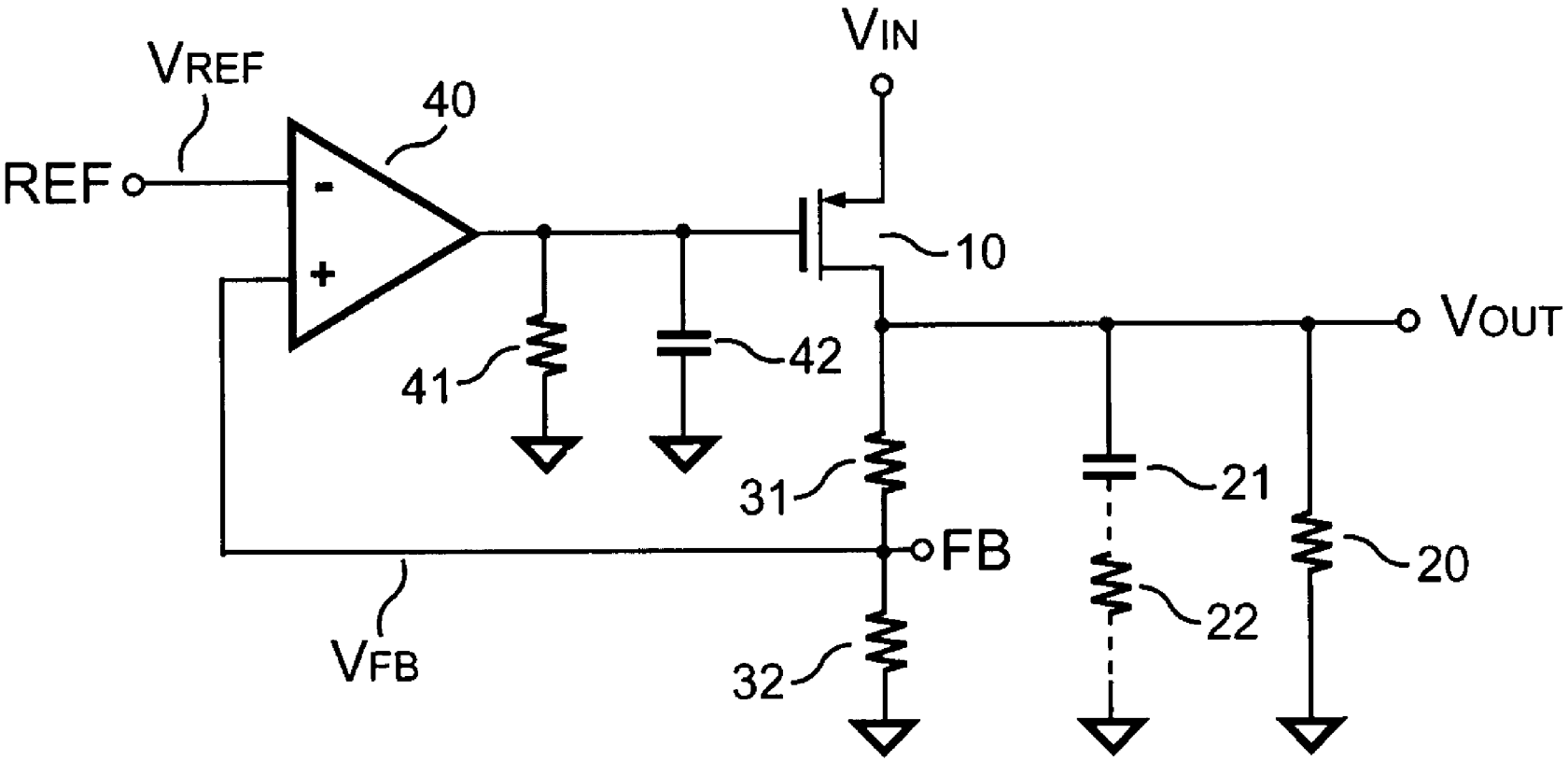
FIG. 1 (Prior Art)
FIG. 1 illustrates a conventional LDO voltage regulator.
Figure 2:
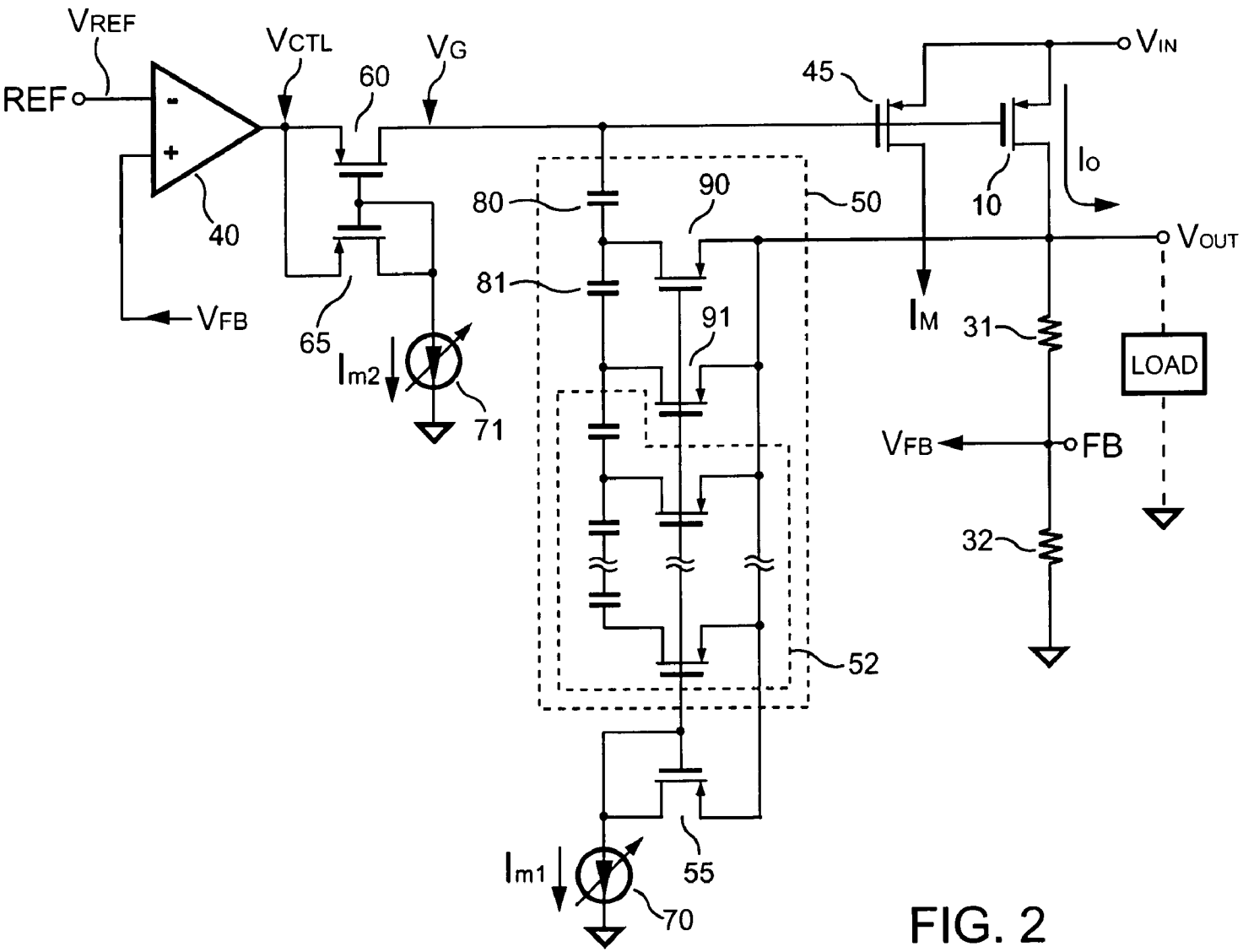
FIG. 2 illustrates an LDO voltage regulator according to an embodiment of the present invention.

Referring to FIG. 2, a basic scheme of an LDO voltage regulator circuit according to a preferred embodiment of the present invention is illustrated. The LDO voltage regulator circuit includes an output pass transistor 10, a mirror transistor 45, a compensation network 50 and an error amplifier 40. An unregulated DC input terminal $V_{IN}$ is connected to a source of the output pass transistor 10 and a source of the mirror transistor 45. An output current $I_O$ is provided from a drain of the output pass transistor 10 that is coupled to a regulated DC output terminal $V_{OUT}$. A gate of the mirror transistor 45 and a gate of the output pass transistor 10 are coupled to each other.

A mirror current $I_M$ is generated from a drain of the mirror transistor 45 in proportion to the output current $I_O$. A control voltage $V_{CTL}$ is supplied from an output of the error amplifier 40. The gate of the output pass transistor 10 is operated with a control voltage $V_G$ that is supplied from a drain of a bias transistor 60. A reference voltage $V_{REF}$ is supplied to a negative input of the error amplifier 40. When the output pass transistor 10 is turned on, a voltage at the unregulated DC input terminal $V_{IN}$ will be transmitted from the unregulated DC input terminal $V_{IN}$ to the regulated DC output terminal $V_{OUT}$. A resistor 31 and a resistor 32 are coupled in series between the regulated DC output terminal $V_{OUT}$ and a reference ground level. A voltage-dividing node FB is located in between the resistor 31 and the resistor 32. A feedback voltage $V_{FB}$ at the voltage-dividing node FB is further supplied to a positive input of the error amplifier 40. A first-mirror current $I_{m1}$ is generated from a programmable current source 70 in proportion to the mirror current $I_M$. The impedance of the compensation network 50 is determined based on a first-mirror transistor 55 in response to the first-mirror current $I_{m1}$. A second-mirror current $I_{m2}$ is generated from a programmable current source 71 in proportion to the mirror current $I_M$. The impedance of the bias transistor 60 is determined based on a second-mirror transistor 65 in response to the second-mirror current $I_{m2}$.

The compensation network 50 is coupled between the gate and the drain of the output pass transistor 10 for compensating the feedback loop. The compensation network 50 includes a first slice having a first capacitor 80 and a first transistor 90 coupled to each other in series. A second slice of the compensation network 50 is coupled in parallel to the first transistor 90, in which the second slice includes a second capacitor 81 and a second transistor 91 coupled to each other in series. The compensation network 50 further includes a distribution network 52 having a plurality of capacitors and transistors connected in parallel with the second transistor 91. The first capacitor 80 is coupled in between the gate of the output pass transistor 10 and a drain of the first transistor 90. A source of the transistor 90 is coupled to the drain of the output pass transistor 10. Sources of the first-mirror transistor 55, the first transistor 90, the second transistor 91 and transistors in the distribution network 52 are coupled to the regulated DC output terminal $V_{OUT}$. Gates of the first transistor 90, the second transistors 91, transistors in the distribution network 52, and the first-mirror transistor 55 are connected together. Thus, the impedance of transistors in the distribution network 52 and the impedance of the first transistor 90 and the second transistor 91 are associated with the impedance of the first-mirror transistor 55.

The gate and a drain of the first-mirror transistor 55 are coupled to each other to form a current mirror. The drain of the first-mirror transistor 55 is further coupled to the programmable current source 70. Therefore the impedance of transistors in the distribution network 52 and the impedance of the first transistor 90 and the second transistor 91 are inversely proportional to the output current $I_O$. The drain of the bias transistor 60 is coupled to the gate of the output pass transistor 10. A source of the bias transistor 60 and a source of the second-mirror transistor 65 are coupled to the output of the error amplifier 40. A gate of the bias transistor 60, a gate of the second-mirror transistor 65 and a drain of the second-mirror transistor 65 are coupled to the programmable current source 71. Therefore, the impedance of the bias transistor 60 is inversely proportional to the output current $I_O$.

The feedback loop is formed along the path from the output of the error amplifier 40, the bias transistor 60, the compensation network 50, the output pass transistor 10, the regulated DC output terminal $V_{OUT}$, and resistors 31, 32 to the positive input of the error amplifier 40. The transfer function of the feedback loop can be expressed as a loop gain, depicted in the following equation:

$$\beta \times G(f) = \beta \times G_{AV} \times G_M \times \frac{\left(1 + j\frac{f}{f_{z1}}\right) \times \left(1 + j\frac{f}{f_{z2}}\right) \times \ldots \times \left(1 + j\frac{f}{f_{zm}}\right)}{\left(1 + j\frac{f}{f_{p1}}\right) \times \left(1 + j\frac{f}{f_{p2}}\right) \times \ldots \times \left(1 + j\frac{f}{f_{pn}}\right)}$$

Where β is a divider ratio of resistors 31 and 32 such as $[R_{32}/(R_{31}+R_{32})]$; $G_{AV}$ is the gain of the error amplifier 40; $G_M$ is the gain of the output pass transistor 10. The poles $P_1$, $P_2, \ldots, P_n$ respectively located at the frequency $f_{P1}, f_{P2}, \ldots, f_{Pn}$ and the zeros $Z_1, Z_2, \ldots, Z_m$ respectively located at the frequency $f_{Z1}, f_{Z2}, \ldots, f_{Zm}$ are produced by the bias transistor 60 and the compensation network 50, where $f_{P1}>f_{Z1}>f_{P2}>f_{Z2>} \ldots >f_{Pn}>f_{Zm}$.

Figure 3:
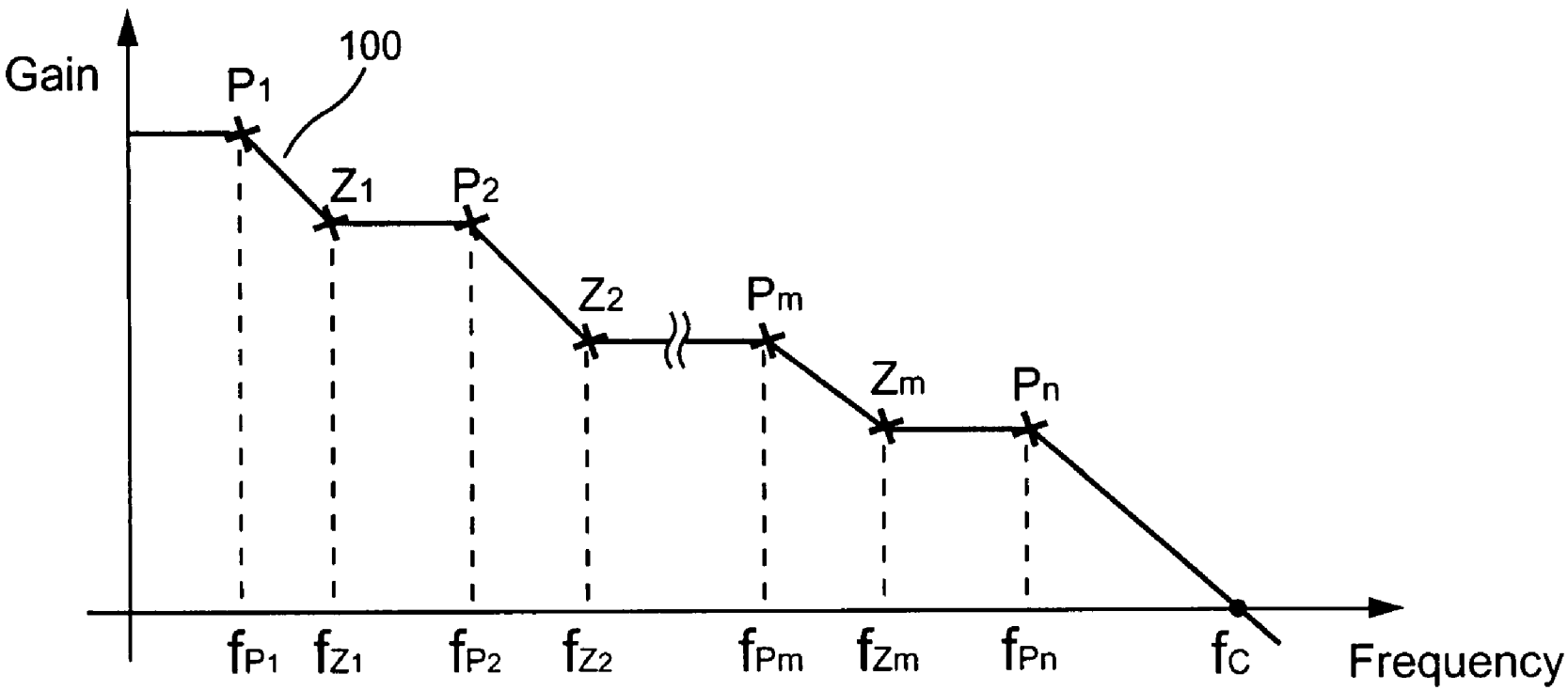
FIG. 3 illustrates the pole-zero locations and crossover frequencies of the transfer function according to an embodiment of the present invention.

Referring to FIG. 3, locations of pole-zero locations and crossover frequency $f_C$ of the transfer function of the feedback loop according to the present invention is depicted, where a solid line 100 represents a frequency response with a resistive load. The pole-zero pairs generated by the compensation network 50 and the bias transistor 60 serve to a maximum phase shift of 45 degrees before reaching the crossover frequency $f_C$.

Figure 4:
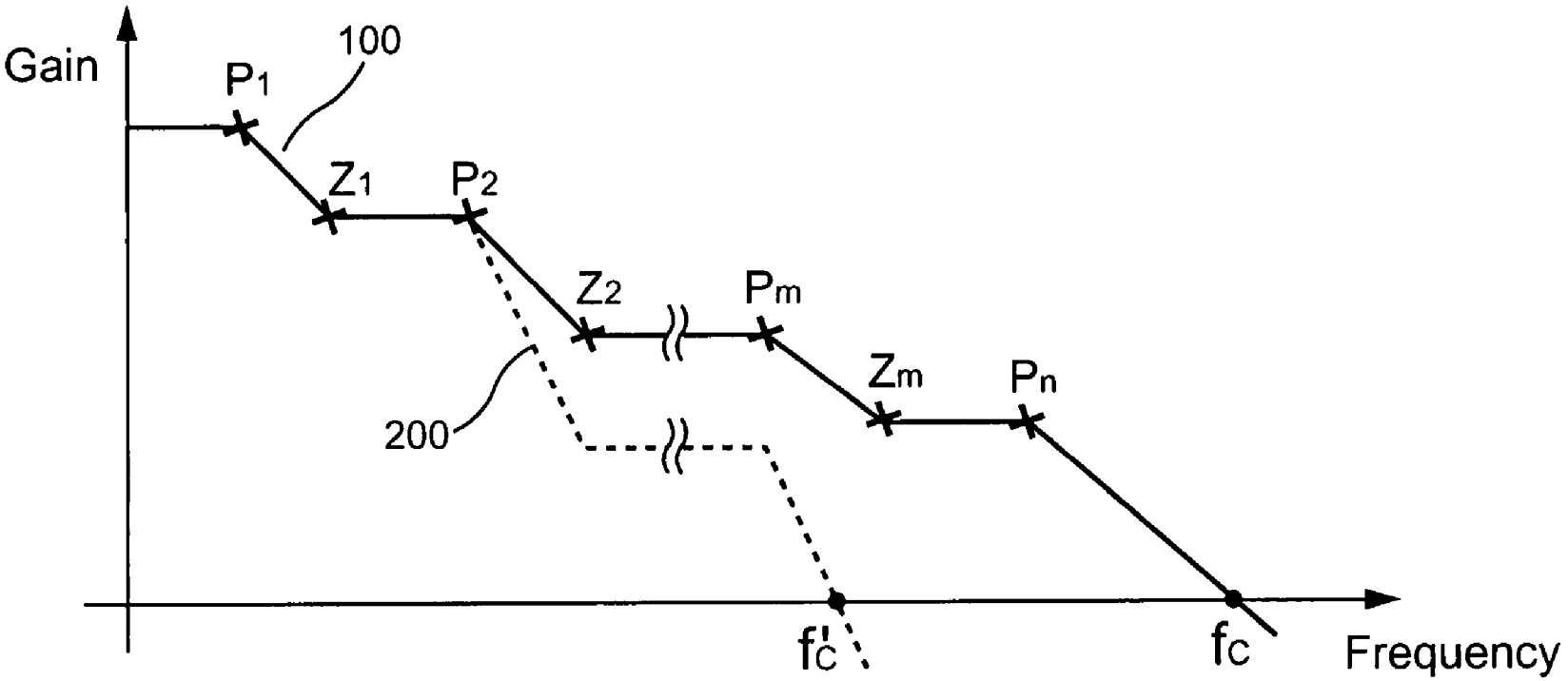
FIG. 4 depicts comparison between the pole-zero locations and crossover frequencies of the transfer function according to the present invention wherein the dotted line indicates the transfer function including an output pole.

Referring to FIG. 4, a comparison between the pole-zero locations and crossover frequencies $f_C$, $f'_C$ of the transfer function according to the embodiment of the present invention is depicted. The dotted line 200 depicts the transfer function including an output pole $P_L$. A minimum phase margin of 45 degrees is reserved for a variety of load impedance. The minimum 45-degree of phase margin refers to a maximum phase shift of 135 degrees at the crossover frequency $f'_C$. For example, an output capacitor is coupled to the regulated DC output terminal $V_{OUT}$. An output capacitance associated with the resistance of the output pass transistor 10 and the load offers an additional output pole $P_L$ to the feedback loop. As the output capacitor includes a parasitic ESR, an output pole-zero pair will be added to the feedback loop. Whatever the output impedance is, a maximum phase shift of 90 degrees is obtained. Therefore, phase margin larger than 45 degrees can be achieved. According to the embodiment of the present invention, the feedback loop of the LDO voltage regulator is inherently stable and is not affect by load conditions.

Figure 5:
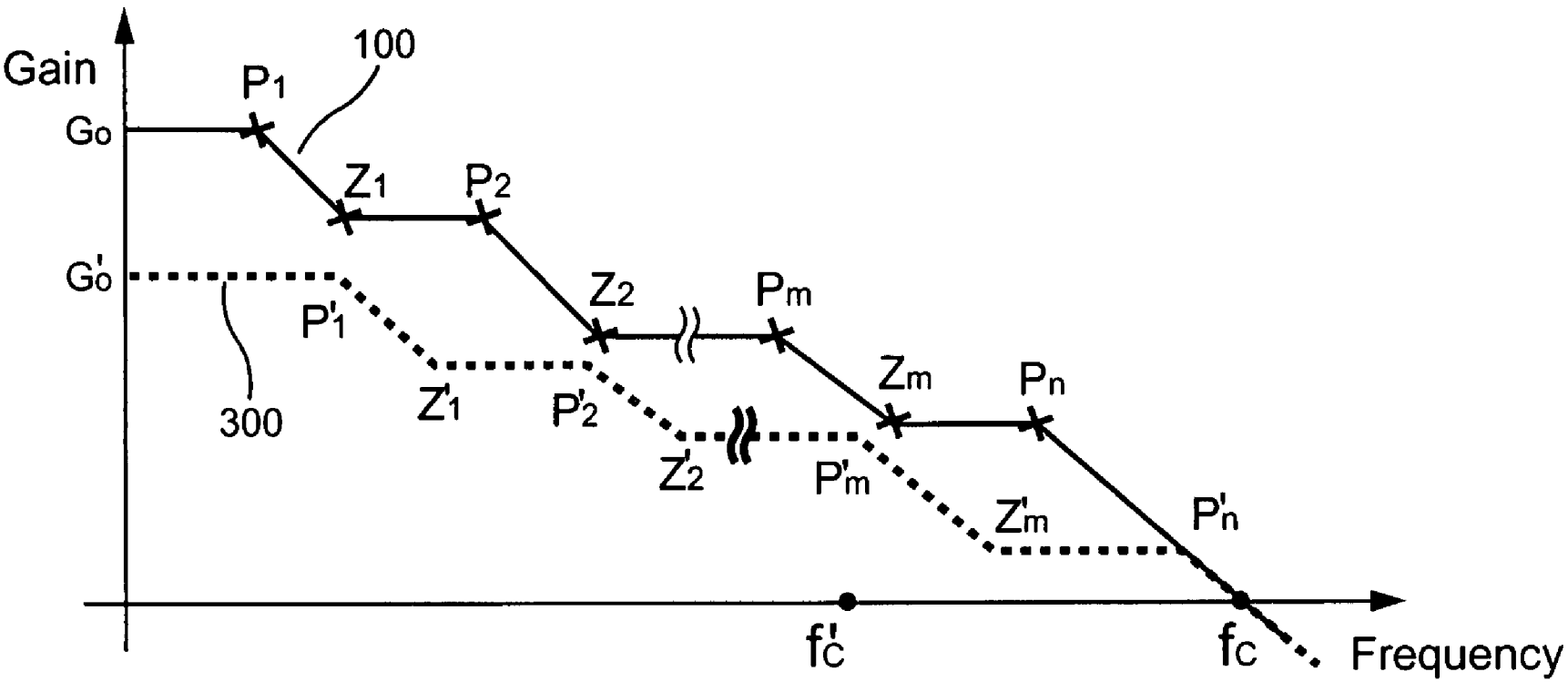
FIG. 5 depicts comparison between the pole-zero locations and crossover frequencies of the transfer function according to the present invention wherein the solid line indicates the transfer function under a light-load and the dotted line indicates the transfer function under a heavy-load.

Referring to FIG. 5, a comparison between the pole-zero locations and crossover frequencies $f_C$, $f'_C$ of the transfer function according to an embodiment of the present invention is depicted. The solid line 100 depicts the transfer function under a light-loaded condition and the dotted line 300 depicts the transfer function under a heavy-loaded condition. Because the gain $G_M$ of the output pass transistor 10 decreases as the load increases, the DC loop gain of the feedback loop will decrease from $G_0$ to $G'_0$. According to the embodiment of the present invention, the pole-zero pairs produced by the bias transistor 60 and the compensation network 50 are adaptively adjusted from $P_1, P_2, \ldots, P_n$ and $Z_1, Z_2, \ldots, Z_n$ to $P'_1, P'_2, \ldots, P'_n$ and $Z'_1, Z'_2, \ldots, Z'_n$ respectively in response to load conditions to optimize the bandwidth for fast transition response. Obviously, according to the present invention, the feedback loop of the LDO voltage regulator retains a similar bandwidth under various load conditions.

It is to be understood that the term transistor can refer to devices including MOSFET, PMOS, and NMOS transistors. Furthermore, the term transistor can refer to any array of transistor devices arranged to act as a single transistor.

Although the invention has been described with reference to a particular embodiment thereof, it will be apparent to those skilled in the art that modifications to the described embodiment may be made without departing from the spirit of the invention. Accordingly, the scope of the invention will be defined by the attached claims and not by the above detailed description.

What is claimed is:

1. A low dropout voltage regulator comprising:

an unregulated DC input terminal;

a regulated DC output terminal, supplying an output current to an output load, wherein said output load is coupled from said regulated DC output terminal to a reference ground level;

an output pass transistor, supplying power to said regulated DC output terminal, wherein said output pass transistor has a source coupled to said unregulated DC input terminal, and said output pass transistor has a drain connected to said regulated DC output terminal;

an error amplifier, for controlling a gate of said output pass transistor;

a bias transistor, coupled between an output of said error amplifier and said gate of said output pass transistor, wherein a drain of said bias transistor is coupled to said gate of said output pass transistor;

a compensation network, coupled between said gate and said drain of said output pass transistor for frequency compensation;

a mirror transistor, for generating a mirror current in proportion to said output current, wherein a source of said mirror transistor is coupled to said source of said output pass transistor, wherein a gate of said mirror transistor is coupled to said gate of said output pass transistor, wherein said mirror current is generated form a drain of said mirror transistor;

a first programmable current source, generating a first-mirror current in proportion to said mirror current;

a first-mirror transistor, for programming the impedance of said compensation network in response to said first-mirror current, wherein a gate and a drain of said first-mirror transistor are coupled to each other to form a current mirror, wherein said drain of said first-mirror transistor is coupled to said first programmable current source;

a second programmable current source, generating a second-mirror current in proportion to said mirror current; and a second-mirror transistor, for programming the impedance of said bias transistor in response to said second-mirror current, wherein a source of said second-mirror transistor and a source of said bias transistor are coupled to said output of said error amplifier, wherein a gate of said bias transistor, a gate of said second-mirror transistor and a drain of said second-mirror transistor are coupled to said second programmable current source.

2. The low dropout voltage regulator as recited in claim 1, wherein the impedance of said bias transistor is inversely proportional to said output current.

3. The low dropout voltage regulator as recited in claim 1, wherein said compensation network comprises:

a first slice, having a first capacitor and a first transistor coupled to each other in series, wherein said first capacitor is coupled between said gate of said output pass transistor and a drain of said first transistor, wherein a source of said first transistor is coupled to said drain of said output pass transistor;

a second slice, coupled to said first transistor in parallel, wherein said second slice comprises a second capacitor and a second transistor coupled to each other in series; and a distribution network, having a plurality of capacitors and transistors coupled to said second transistor in parallel, wherein sources of said first-mirror transistor, said first transistor, said second transistor and transistors in said distribution network are coupled to said drain of said output pass transistor, wherein gates of said first transistor, second transistor and transistors in said distribution network are coupled to said gate of said first-mirror transistor.

4. The low dropout voltage regulator according to claim 1, wherein the impedance of said first transistor, said second transistor, and transistors in said distribution network are associated with the impedance of said first-mirror transistor.

5. The low dropout regulator as recited in claim 1, wherein the impedance of said first transistor, said second transistor, and transistors in said distribution network are inversely proportional to said output current.

6. The low dropout voltage regulator as recited in claim 1, wherein said compensation network and said bias transistor generate a plurality of pole-zero pairs for frequency compensation, wherein frequencies of said pole-zero pairs increase as said output current increase for obtaining prompt transient response.

* * * * *